United States Patent [19]

Marforio

[11] 4,040,368

[45] Aug. 9, 1977

[54] CLOSURE COVER FOR AN OPENING PROVIDING ACCESS TO SEWING MACHINE MECHANISMS

[76] Inventor: Nerino Marforio, Via Soderini 35/A, Milan, Italy

[21] Appl. No.: 716,134

[22] Filed: Aug. 20, 1976

[30] Foreign Application Priority Data

Sept. 17, 1975 Italy ..... 22301/75

[51] Int. Cl.[2] ..... D05B 75/00
[52] U.S. Cl. ..... 112/258
[58] Field of Search ..... 112/258, 260, 63, 215, 112/216

[56] References Cited

U.S. PATENT DOCUMENTS

| | | | |
|---|---|---|---|
| 1,928,486 | 9/1933 | Gruman | 112/258 |
| 2,199,666 | 5/1940 | Kucera | 112/215 |
| 2,318,836 | 5/1943 | Clayton | 112/258 |

*Primary Examiner*—George H. Krizmanich

[57] ABSTRACT

A closure cover for the opening in the base of a sewing machine which provides access to the thread control members for the lower hook. The cover is carried on a rod which is vertically slidable and rotatably carried in the base and includes a combined spring biased locking and release arrangement the first of which maintains the cover in operating position on the base, and the second which releases the cover. Upon release the cover is automatically raised by a spring member and can be pivoted to a position to facilitate access to the members within the opening.

5 Claims, 3 Drawing Figures

CLOSURE COVER FOR AN OPENING PROVIDING ACCESS TO SEWING MACHINE MECHANISMS

BACKGROUND OF THE INVENTION

The present invention relates to a closure cover for an opening providing access to sewing machine mechanisms, more particularly, to the thread control elements for the lower hook; these elements being housed, for example, in sewing machines having a cylindrical base or a U-shaped base.

In conventional sewing machines of this type the covers which have hitherto been employed have been shaped so as to conform at least partially to the shape of the base to which the covers are hinged.

These covers are, for the large part, pivotable towards the sewing machine operator.

Owning to the fact that the covers conform to the shape of the base, they are not provided with means for facilitating opening of the same so as not to obstruct the free sliding of the workpiece during the stitching operation.

Consequently, the covers used on conventional machines have the disadvantage of being bulky and difficult to grip in order to open the same.

The object of the present invention is to obviate these disadvantages and to facilitate rapid opening of the cover so as to render the thread control elements readily accessible.

SUMMARY OF THE INVENTION

To attain this object it was necessary to provide an opening means which does not require integral gripping devices that would be capable of obstructing the sliding of the workpiece on the sewing machine during the stitching operation.

The solution provided by the present invention consists in a closure cover of the aforementioned type which is characterized in that it comprises flexible retaining means adapted to keep the cover in a closed position, combined with lifting means that is adapted to move the cover into an open position.

In addition, the cover is pivotable about a vertical pin such that in the closed position the cover is level and forms a continuation of the sliding surface for the workpiece on the base of the sewing machine and in the open position it may be rotated rearwardly with respect to the base.

The advantage provided by the present invention is that of being able to open the cover in response to the mere pressure of the flexible cover retaining means. The cover is then raised from the seat on which it is held and it is connected to a part that is effective in rotating it to a suitable position in a zone in which it will not obstruct the operator's movements.

Other objects, features and advantages of the present invention will be made apparent in the following description thereof provided with reference to the accompanying drawings by way of example only, in which:

DESCRIPTION OF THE PREFERRED EMBODIMENT

Figure 1:
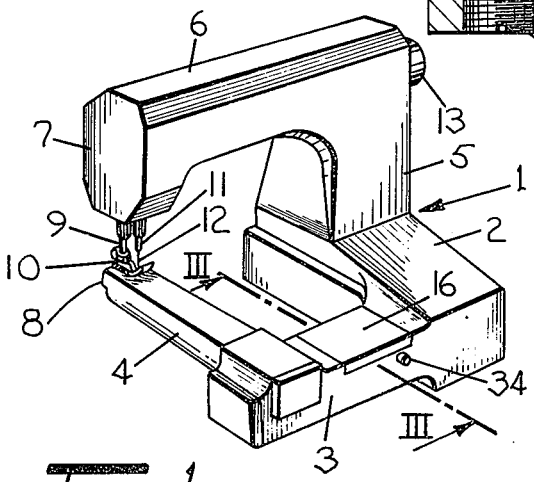
FIG. 1 is a perspective view of a sewing machine to which the device according to the invention is applicable.

Referring now to FIG. 1 a sewing machine of the type having a U-shaped base comprises a casing 1 consisting of a base which generally is made up of three parts, 2, 3 and 4 disposed at right angles to one another so as to form an essentially horizontal "U"-shaped base having a vertical upright 5 mounted on the first of these parts and on which is mounted a projecting arm 6 terminating in a head 7 which is disposed above the free end 8 of the third part 4 of the base.

A conventional pressure device consisting of a pressure bar 9 and a presser foot 10 as well as the usual upper sewing elements including a needle bar 11 and a needle 12 are mounted in the head 7.

The arm 6 houses the actuating members for the pressure device and for the upper sewing elements.

The actuating members for the sewing elements also include a handwheel 13 located on one end of arm 6 (FIG. 1). The second and third parts of the base house the elements for actuating the conventional lower sewing elements, which are those for driving the workpiece advancement device and also lower sewing elements for controlling the lower thread.

More specifically, the above-mentioned thread control elements are contained in the second part.

All the elements and actuating devices — with the exception of those mentioned above — have been omitted from the accompanying drawings as they do not contribute to the present invention.

Figure 2:
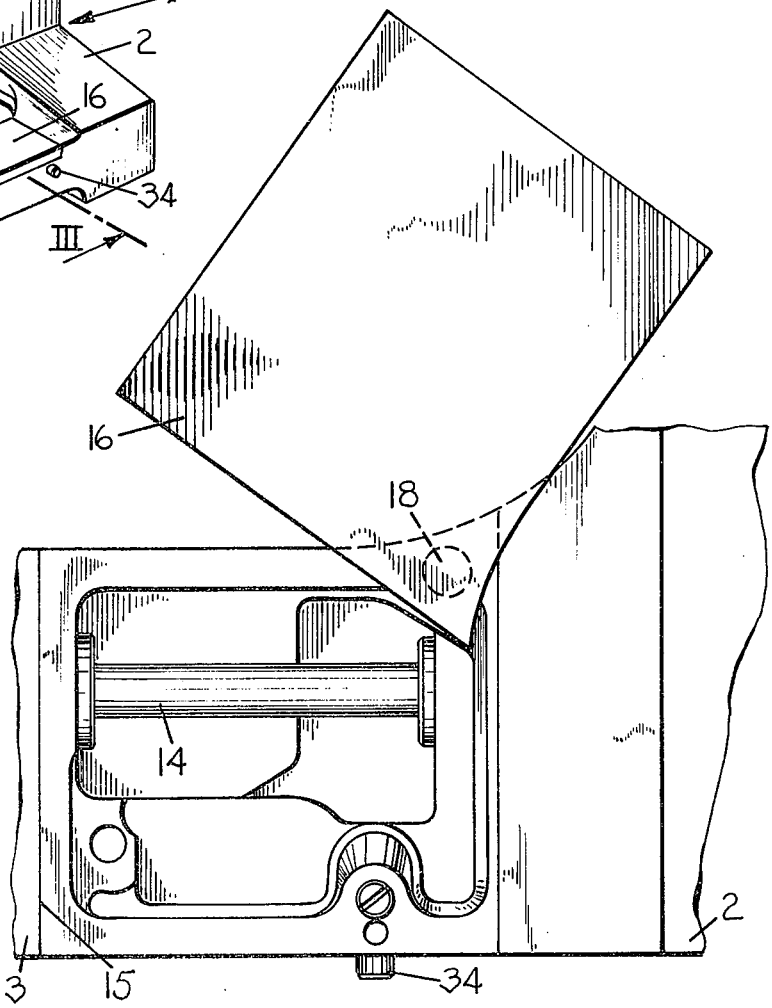
FIG. 2 is a plan view of a portion of the base of the sewing machine shown in FIG. 1.

To obtain ready access to the elements contained in the second part 3 — and represented in FIG. 2 by a shaft 14 of the machine, an opening 15 is provided in the upper surface of part 3. A closure cover 16 is mounted in this opening in such a way that when the cover is closed over this opening, it is flush with all adjacent surfaces of part 3.

This condition is necessary to avoid obstructing the operator's movements when manipulating the workpiece to be sewn.

Figure 3:
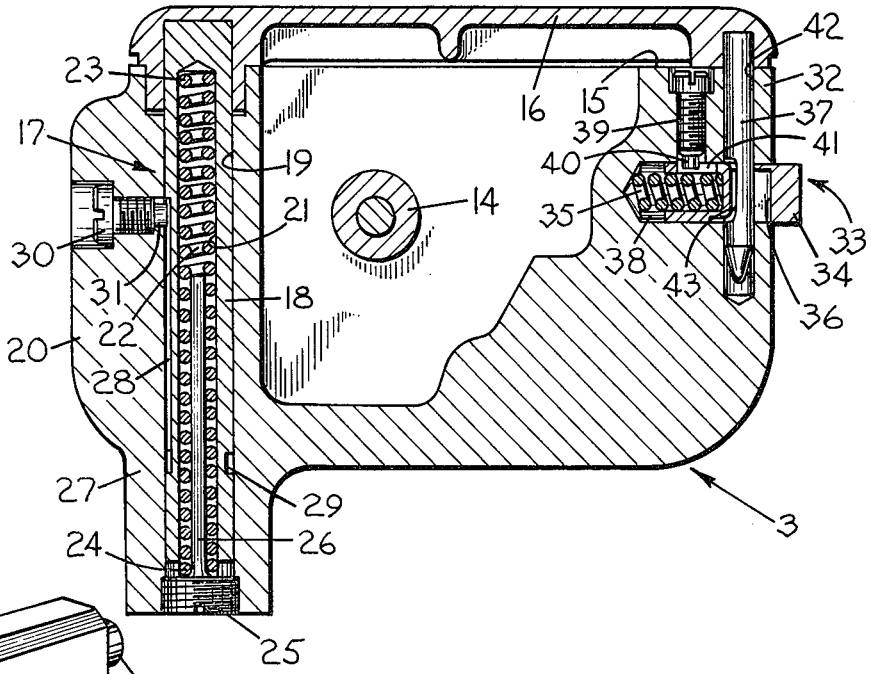
FIG. 3 is an elevational view of an enlarged section along line III—III in FIG. 1.

In addition, to avoid obstructions when performing some function on the elements connected to the shaft 14, by way of the opening 15, the closure cover 16 includes a lifting means 17 for raising it from its seat so that it can be rotated towards the rear part of the second part 3 (FIGS. 2 and 3).

The lifting means 17 includes a rod 18 depending from and having one end fixed in the lower surface of the cover 16. Pin 18 is slidably assembled in a seat 19 formed in the rear wall 20 of the second part 3. The rod 18 includes an axial bore 21 which houses a compression spring 22. This spring being partially compressed causes end 23 to apply an upward biasing force on the cover 16 and a downward force by the end 24 on a threaded plug 25 which assemblies in the lower surface 27 of the second part 3. As shown in FIG. 3, the threaded plug 25 is provided with an integrally formed and upwardly extending pin 26 which serves as a positioning and guide element for the compression spring 22.

The pin 18 is provided on its external surface with a longitudinal channel or groove 28 which terminates in a circumferential channel or groove 29 located adjacent the lower end of said pin.

The grooves are provided to limit the movements of the closure cover 16.

Assembled in the rear wall 20 of the second part 3 is a guide screw 30 having an end portion 31 of which is positioned in either of the grooves 28 or 29 depending on the position of the cover.

More specifically, the longitudinal groove is so disposed on the pin 18 that it is only in engagement with the guide screw when the closure cover is aligned with the opening 15, thus permitting the cover to be raised and lowered.

The circumferential groove 29 is so positioned on the pin that it is only in engagement with the guide screw 30 when the closure cover is fully raised above the surface of the second part 3, thus enabling this cover to be rotated about its pivot point.

The combination of the two longitudinal and circumferential grooves thus controls the action of the compression spring 22 which when permitted to expand raises the cover from its seat until the end portion 31 of the guide screw 30 enters into the groove 29.

To retain the closure cover on the opening 15 against the action of the compression spring 22, a retaining and release means 33 is provided in the forward portion 32 of this part. The retaining means includes a knob 34 disposed opposite a coil spring 35. This knob is provided with a bore 36 that traverses the axis thereof into which a pin 37 extending downwardly from the closure cover 16 is adapted to be inserted.

The knob 43 is assembled in a bore 38 formed at a right angle to the forward portion 32 and is held in its bore by a check screw 39 having an end portion 40 of which is located in a slot 41 provided in the upper surface of the knob.

By virtue of this coupling, the knob is continuously urged outwardly by the biasing force of spring 35 and is maintained within the bore 38 by means of the check screw 39.

When the pin 37 carried by the closure cover 16 is inserted in a bore 42 provided in the part 3 it extends through the bore 38 housing the knob 34 as well as the bore 36 in the knob 34. The pin 37 is provided with a recess 43 which faces towards the pressure spring 35 and, under the thrust of the latter, the knob is engaged therein to retain the cover in the closed position.

If pressure is exerted on the outside of the knob 34, thus moving it inwardly, the pin 37 will obviously be disengaged, thus releasing the cover which is raised by the biasing force of the compression spring 22.

The cover is closed by rotating it manually in the opposite direction and simultaneously exerting slight downward pressure thereon.

As a result, and by virtue of a reciprocal movement, the guide screw 30 is slid into the circumferential groove and, as soon as the longitudinal groove is aligned with the screw, the end 31 of the latter penetrates it, thus enabling the cover to be fully lowered.

The pin 37 simultaneously becomes coupled to the knob 34 as the position of the longitudinal groove 28 with respect to the pin 37 is such that the latter is aligned with the bore 42 when this groove 28 is engaged by the checking screw 30.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A device for selectively opening and closing the opening providing access to the thread control members for the lower hook in sewing machines of the type having cylindrical and U-shaped bases, said device comprising:

a. a closure cover (16) attached to the sewing machine base;

b. means (33) assembled in the base in operative association with such closure cover (16) for retaining and releasing the latter from a position of locking engagement with the opening (15) in the base; and c. means (17) assembled in the base operatively connected to said closure cover for raising the latter to position clear of the opening in the base upon actuation of said releasing means.

2. The device according to claim 1 wherein said retaining and releasing means includes a spring biased knob (34) selectively movable from locking engagement with a pin (37) fixed in and depending from said closure cover (16) to a position to effect actuation of said raising means.

3. The device according to claim 1 wherein said raising means includes a rod member (18) fixed to said closure cover (16) and slidably and rotatably assembled in said base.

4. The device according to claim 3 wherein said raising means includes a spring (22) operatively associated with said rod member (18) for raising the latter and said closure cover (16) upon actuation of said knob (34).

5. The device according to claim 4 wherein said rod member includes means defining a longitudinally extending channel (28) and a circumferential channel (29) communicating therewith which a guide screw (30) is operatively associated for limiting the raising and rotational distances of said closure cover (16).

* * * * *

UNITED STATES PATENT AND TRADEMARK OFFICE

CERTIFICATE OF CORRECTION

PATENT NO. : 4,040,368

DATED : August 9, 1977

INVENTOR(S) : Nerino Marforio

It is certified that error appears in the above-identified patent and that said Letters Patent are hereby corrected as shown below:

--Assignee: Rockwell-Rimoldi, S.p.A., Milan, Italy--

Column 2, Line 15, delete "pressure", both occurrences, and insert --presser--, both occurrences.

Column 2, Line 19, delete "pressure", and insert --presser--.

Column 3, Line 28, delete "43" and insert --34--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*